United States Patent [19]

Koch et al.

[11] 4,003,129

[45] Jan. 18, 1977

[54] METHOD OF MAKING CURRENT LIMITING FUSE HAVING A FILTER DISPOSED IN ONE END CAP

[75] Inventors: Robert E. Koch, Pittsfield; James H. Ceder, Lenox, both of Mass.

[73] Assignee: General Electric Company

[22] Filed: Jan. 23, 1976

[21] Appl. No.: 651,707

Related U.S. Application Data

[62] Division of Ser. No. 621,053, Oct. 9, 1975, Pat. No. 3,967,228.

[52] U.S. Cl. ..... 29/623; 29/614

[51] Int. Cl.[2] ..... H01H 69/02

[58] Field of Search ..... 29/623, 614, 615; 337/158, 159, 186, 187, 248, 414, 415, 273, 276

[56] References Cited

UNITED STATES PATENTS

| | | | |
|---|---|---|---|
| 3,465,275 | 9/1969 | Swain | 337/159 X |
| 3,479,630 | 11/1969 | Kozacka | 337/159 |
| 3,810,062 | 5/1974 | Kozacka | 337/276 X |
| 3,838,375 | 9/1974 | Frind et al. | 337/276 |

*Primary Examiner*—Victor A. DiPalma
*Attorney, Agent, or Firm*—Volker R. Ulbrich

[57] ABSTRACT

The fuse is of the type including an electrically insulating cartridge, a pair of electrically conductive terminal caps at opposite ends of the cartridge, a fusible element within the cartridge in electrical contact with the terminals, and a self-supporting bound matrix filler of arc-quenching particulate matter. The improvement comprises that one of the terminal end caps has a filter disposed on its inside end surface over a drain port.

Also disclosed is a method of manufacturing a fuse. The method comprises the steps of assembling the components, packing with arc-quenching particulate matter, filling with a suspension of colloidal silica, removing excess suspension, and drying. In filling, the colloidal silica suspension is forced into a fill port in one end cap and released through a drain port in the other end cap. Before passing out through a drain port in the other end cap, the suspension passes through a filter disposed on the inside end surface of the end cap and overlapping the drain opening.

3 Claims, 2 Drawing Figures

METHOD OF MAKING CURRENT LIMITING FUSE HAVING A FILTER DISPOSED IN ONE END CAP

This is a division of application Ser. No. 621,053, filed Oct. 9, 1975 now U.S. Pat. No. 3,967,228.

BACKGROUND OF THE INVENTION

The invention relates generally to electrical current limiting fuses, and particularly to such fuses of the type containing a particulate arc-quenching filler which is bound together into a self-supporting matrix by an inorganic refractory binder. The invention also relates to methods for manufacturing the same.

A current limiting fuse is a special type of fuse which can interrupt a large current at a high voltage in a controlled manner to prevent the occurrence of damaging high voltage transients. Such transients result when the current is interrupted too suddenly. One of the most generally used types of current limiting fuses is the so-called particulate porous matter filled cartridge fuse. In such a fuse, a conductive fusible element, or link, is enclosed in an insulating cartridge, or tube, between two terminal end caps and surrounded by an arc-quenching filler of tightly packed particulate matter, such as silica sand. When the fusible element melts, the resulting arc interacts with the surrounding filler in such a manner that the resistance of the fuse is rapidly, but gradually, increased to the point when the arc can no longer be sustained, thus breaking the circuit in a controlled fashion.

Efforts to improve the performance of such fuses by better control of the interaction of the arc with the filler have led to fuses in which the filler particles are bound together by an inorganic refractory binder, such as colloidal silica. Such a fuse, as well as the manner of making it, is described in detail, for instance, in U.S. Pat. No. 3,838,375 issued 24 Sept. 1974 to Frind et al. and assigned to the same assignee as are the rights to the instant invention.

As is described in the above-cited patent, the filler may be bound together by the admixing therewith either prior to filling or subsequent to the filling of a suitable inorganic binder which is applied in sufficient quantity to coat each individual particle of the filler over substantially the entire surface thereof without substantially diminishing the porosity of the matrix of filler inside the fuse. For the production of large numbers of fuses by the latter approach, the fuse is filled with sand through a fill port in one end cap while being vigorously vibrated, so that the sand is closely packed. Then the fuse is filled with a saturated suspension of colloidal silica in water. Next, the excess suspension is drained out through a drain port in the other end cap. A filter is inserted in the drain port or held against the outside of the end cap over the drain port to restrain the filler. Then the fuse is dried by passing compressed dry air through the interior and baking.

One problem with the present approach of binding the filler is that it frequently takes too long a time to fill the colloidal suspension into the fuse. For draining the excess solution from the fuse 10, it is desirable that the drain port be down and the fill port be up, so that gravity does not work against the movement of the suspension to the drain port. It is desirable, that the drain port be down also from the standpoint of preventing the suspension from running over the tube housing and end caps upon disconnection of the fuse from the fill and drain lines. On the other hand, the filling with suspension would be aided by having the drain port up, but it would be an undesirable hindrance to manufacturing speed to have the fuse with filter down at the drain step, but in the up position for the filling step. Therefore, it has been the practice to orient the fuse with the filter down for the entire production process.

When the filter is in the down position and the suspension is filled into the fill port, some of the suspension immediately makes its way to the filter and wets it, before all the sand in the fuse has been contacted and wetted by the suspension. The wetted filter blocks the rapid passage of air needed to fill the fuse 10 completely with suspension. As the filter is at most about the same diameter as is the relatively small drain port 24, a complete filling of the fuse with suspension therefore can typically require on the order of one quarter to a half hour per fuse, sometimes much longer.

SUMMARY OF THE INVENTION

The novel fuse has a filter assembly disposed over the drain port on the inside bottom surface of an end cap. The filter assembly is of a type permitting lateral flow between it and the inside cap surface, so that the effective filtering area can be much larger than the diameter of the drain port. This permits a rapid introduction of the colloidal silica solution, even if the filter is wetted before complete filling.

The fuse is manufactured by a novel method, including the steps of filling the fuse by forcing a suspension into the fill port and releasing it from the other end of the fuse through a particulate filter with an effective filtering area much greater than the drain port just before it passes through the drain port.

DESCRIPTION OF THE PREFERRED EMBODIMENT

Figure 1:
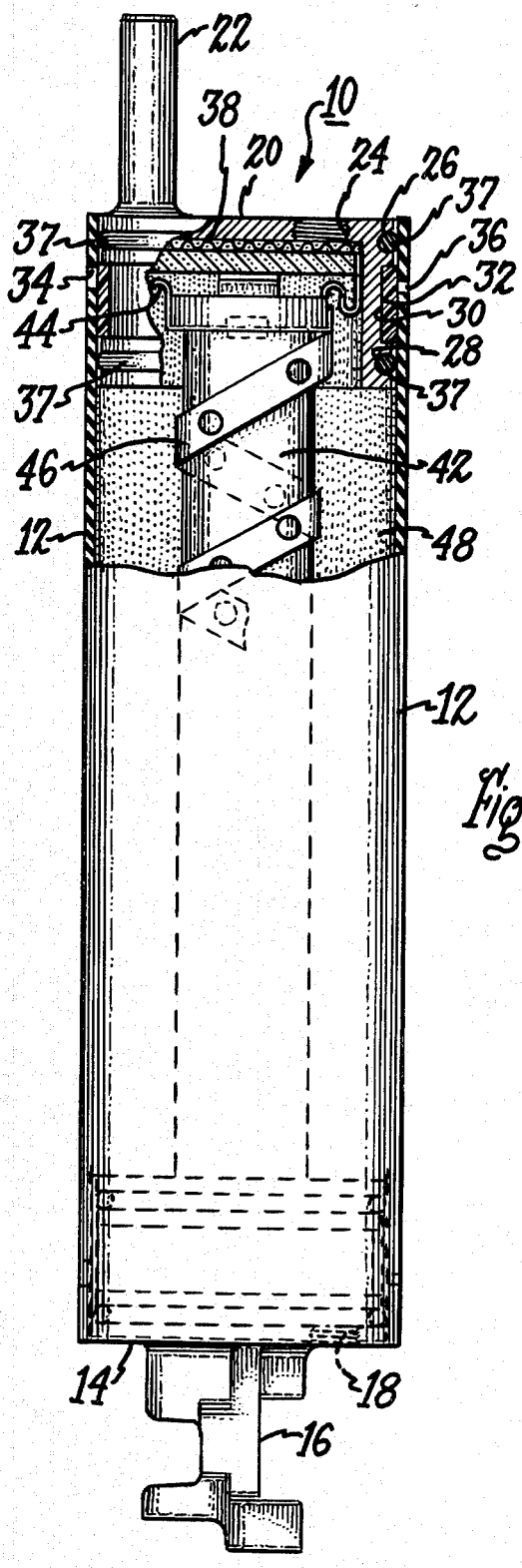
FIG. 1 is a partially sectioned side view of a fuse in accordance with the preferred embodiment of the invention, showing an end cap containing a filter.
Figure 2:
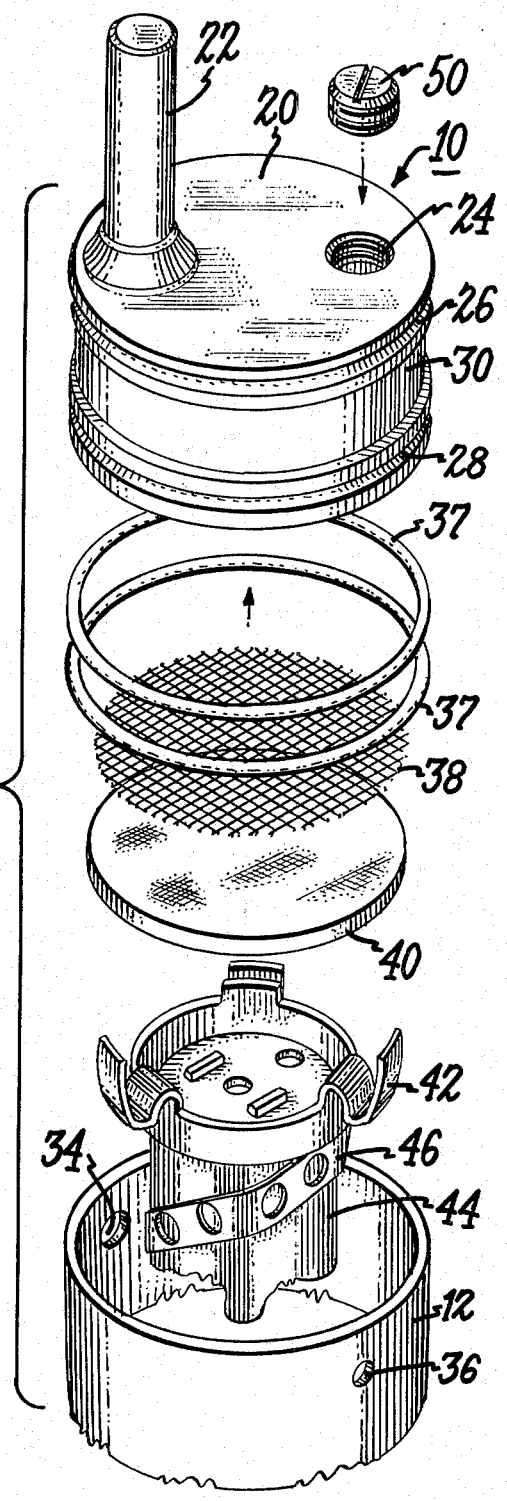
FIG. 2 is an exploded perspective view of the various parts of the end cap of FIG. 1, including the filter assembly.

A preferred embodiment of the invention is the fuse 10 shown in FIGS. 1 and 2 of the drawings. The fuse 10 is encased in a glass-epoxy housing tube 12 closed at one end by a cast bronze end cap 14, which is provided with a terminal base 16 and a fill port 18. The other end of the fuse 10 is closed by a cast bronze end cap 20, which is provided with a connecting stud 22 and an outlet port 24.

The end caps 14, 20 are sealed to the inside of the tube by an annular, settable adhesive seal structure shown in FIG. 1 only for the end cap 20. The outer perimeter of the end cap 20 has formed in it an outer O-ring groove 26 and an inner O-ring groove 28. Between the grooves 26, 28 is an annular recess 30, which is filled with a thermosetting one-part structural epoxy adhesive composition to bond the cap 20 to the inside surface of the fuse tube 12. After the end cap 20 is inserted in the tube 12, the epoxy is injected into the annular recess 30 through an injection aperture 34 in the tube 12, while air escapes through a bleed aperture 36 in the opposite side of the tube 12. O-ring 37 in the grooves 26, 28 prevent the epoxy from escaping the recess 30.

Disposed on the inside surface of the end cap 20 is a woven aluminum wire support screen 38 on which there rests a ceramic fiber filter pad 40. A copper element connector 42 is soldered to the inside perimeter of the end cap 20. Attached to the element connector 42 is one end of a ceramic support core 44, about which there is helically wound a perforated silver fusible ribbon element 46. The entire interior of the fuse 10 is filled with 40-mesh purified silica sand 48 bound together into a self-supporting matrix with colloidal silica by the process described below.

In the process of manufacturing the fuse 10, the various component parts are first assembled. Then the interior of the fuse 10 with end cap 14 down, is filled with the quartz sand through the fill port 18. Now, fittings are installed in the inlet and outlet ports 18, 24 and a suspension of 30% by weight of colloidal silica in water is introduced at a pressure of about 2 atmospheres into the fill port 18. The suspension flows through the fuse 10, wetting the sand and passes through the filter pad 40 and screen 38 to drain out through the drain port 24. The sand 48 is prevented from passing through the pad 40. The screen 38 under the filter pad 40 permits the suspension to flow freely between the pad 40 and the inside surface of the end cap 20, thus greatly increasing the effective size of the filter pad 40 over the effective size that would be obtainable were the filter immediately covering the outlet port 24. The greater filter area results in a relatively rapid filling of the fuse, which requires on the order of seconds, even when the filter pad 40 is wetted before the filling is complete. Compressed air is then forced into the fill port 18 at a pressure of about 2 atmospheres to force out excess solution.

The interior of the fuse 10 is dried by baking the fuse 10 in an oven at about 140 degrees Celsius for about one hour and then placing it into a vacuum chamber to remove the last traces of moisture. As the moisture is removed from the residual suspension, the particles settle out and bind the sand 48 into a self-supporting matrix. Thereafter, threaded lugs 50 are inserted in the fill and drain ports 18, 24 to seal the interior of the fuse 10. The exterior of the tube 12 and exposed outside end surfaces of the caps 14, 20 are coated with an epoxy sealant to improve weather resistance.

The larger effective filter area provided by the filter pad 40 also appears to improve the uniformity of the final sand matrix 48 by preventing the formation of striations in the matrix, which can affect the performance of the fuse.

We claim:

1. The method of manufacturing a current limiting fuse, comprising the steps, of:

a. assembling internal components of the fuse in a housing which includes end caps provided, respectively, with fill port and drain port;

b. packing the fuse with a particulate filler;

c. filling the fuse with colloidal silica suspension by forcing said suspension into said fill port and passing it at the other end of said fuse through a filter just before it drains out through said drain port;

d. removing excess solution from said fuse, and e. drying said fuse by passing a drying gas through said fuse to remove the fluid from the residual suspension and to thereby result in a bonding together of said particulate filler inside said fuse.

2. The method claimed in claim 1 and wherein said steps *c*, *d* and *e* are repeated at least once after the initial completion of step *e*.

3. The method claimed in claim 1 and wherein said drying includes a baking of said fuse at a temperature of at least 100° Celsius.

* * * * *